United States Patent [19]

Linka et al.

[11] Patent Number: 4,850,399

[45] Date of Patent: Jul. 25, 1989

[54] WEAVING LOOM WITH PNEUMATIC WEFT THREAD INJECTION

[75] Inventors: Aldof Linka; Frank Lanthaler, both of Hechingen/Bechtoldsweiler; Heinrich Frommelt, Grosselfingen, all of Fed. Rep. of Germany

[73] Assignee: Lindauer Dorner Gesellschaft m.b.H., Lindau/Bodensee, Fed. Rep. of Germany

[21] Appl. No.: 163,619

[22] Filed: Mar. 3, 1988

[30] Foreign Application Priority Data

Jun. 27, 1987 [DE] Fed. Rep. of Germany ..... 3721309
Jun. 27, 1987 [DE] Fed. Rep. of Germany ..... 3721310

[51] Int. Cl.[4] ..... D03D 51/00

[52] U.S. Cl. ..... 139/436; 139/13 R; 139/452

[58] Field of Search ..... 139/13 R, 436, 452, 139/437, 224 R

[56] References Cited

U.S. PATENT DOCUMENTS

| | | | |
|---|---|---|---|
| 3,049,155 | 8/1962 | Livermore . | |
| 3,256,914 | 6/1966 | Hortmann | 139/437 |
| 3,618,640 | 11/1971 | Linka . | |
| 3,626,990 | 12/1971 | Linka . | |
| 3,749,135 | 7/1973 | Linka . | |
| 4,410,017 | 10/1983 | Linka | 139/436 |

FOREIGN PATENT DOCUMENTS

| | | | |
|---|---|---|---|
| 83864 | 5/1955 | Czechoslovakia . | |
| 1066958 | 10/1959 | Fed. Rep. of Germany . | |
| 1287526 | 1/1969 | Fed. Rep. of Germany . | |
| 2800639 | 8/1979 | Fed. Rep. of Germany . | |
| 2938921 | 4/1981 | Fed. Rep. of Germany . | |
| 3346030 | 6/1985 | Fed. Rep. of Germany . | |
| 2038892 | 7/1980 | United Kingdom | 139/452 |

*Primary Examiner*—Henry S. Jaudon
*Attorney, Agent, or Firm*—Frishauf, Holtz, Goodman & Woodward

[57] ABSTRACT

To provide for accurately timed injection of selected lengths of weft threads to shuttles moving, in sequence, in front of injectors (85, 545), a continuously rotating measuring drum (32) has the weft thread (51, 180) passing in front thereof, the weft thread being clamped against the measuring roller by a pressure roller (35) or a selected one of a plurality of pressure rollers (511), the operating mechanism being coupled to and driven by the main drive (21, 22, 23, 24) of the weaving loom so that exact synchronism of movement of the shuttle in front of the injectors is ensured as the thread is being delivered. Auxiliary functions such as operation of a thread brake (50), a thread retraction mechanism (56), thread cutting by a cutter (99) and the like can, additionally, be controlled from a main drive shaft (34, 54) of the injection apparatus which is in positive geared driving engagement (22; 91-96) with the machine or loom drive shaft (22), or electrically controlled by an electrical control unit (552) which receives drive or shuttle position inputs (554) from the machine drive.

41 Claims, 7 Drawing Sheets

WEAVING LOOM WITH PNEUMATIC WEFT THREAD INJECTION

Reference to related patents, the disclosure of which is hereby incorporated by reference: U.S. Pat. No. 3,049,155, U.S. Pat. No. 3,618,640, U.S. Pat. No. 3,626,990, U.S. Pat. No. 3,749,135, Linka U.S. Pat. No. 4,410,017, linka, corresponding to German No. 30 16 182.

Reference to related disclosures, illustrating the state of the art: German Patent Disclosure Documents DE-OS Nos. 33 46 030; 28 00 639 Czechoslovakian Pat. No. 83,864, German Pat. No. 1,066,958 German Pat. No. 1,287,526.

Reference to related applications, the disclosure of which is hereby incorporated by reference, and assigned to the assignee of this application:

U.S. Ser. No. 07/146,263, filed Jan. 20, 1988, LINKA et al.

U.S. Ser. No. 07/123,376, filed Nov. 20, 1988, LINKA

U.S. Ser. No. 07/131,637, filed Dec. 11, 1987, LINKA et al.

U.S. Ser. No. 07/123,597, filed Nov. 20, 1987, LINKA

The present invention relates to weaving looms, and more particularly to multiple weaving looms, in which a plurality of shuttles are guided through sheds formed in the warp threads, and more particularly to an arrangement or system to introduce weft threads of finite length into the respective shuttles as they pass a weft thread injection station.

Background

Pneumatic weft injection apparatus to inject weft threads of predetermined length into shuttles passing through a shed are known. In such weft injection apparatus, a measuring drum which is driven in a suitable manner pulls threads off a thread supply package or the like by means of a pressure roller which engages the measuring drum. A finite length of thread is prepared by severing the thread, after a predetermined length has been spooled off, for example by the measuring drum, and by monitoring the rotation thereof. The engagement of the pressure roller against the measuring drum can be controlled so that, when the finite length of thread has been spooled off, it can be passed through an injection nozzle where it is injected, by compressed air or similar compressed gas into a thread receiving chamber of the shuttle.

The path of the shuttle through the shed is guided across the width of the fabric at least over a substantial portion by a guide reed. The shuttle, guided on the guide reed, is moved by magnetic coupling to magnetic shuttle moving elements or travelers, carried along the shed, for example by an endless chain or the like. Magnetic coupling between the shuttle and the traveler moves the shuttle through the shed, while the traveler can pass outside thereof and a plurality of shuttles pass through the shed which travels along the length of the fabric. In a multi-system, multi-path weaving loom, a separate weft thread supply station is provided for each fabric web to be made. Each station has a pneumatically operated injector with an injection nozzle which supplies the shuttles with the weft threads of finite length as they pass, sequentially, by the injection station, and as they move therealong. Relative movement of the shuttles with respect to the injection nozzle permits positioning the weft thread uniformly in the shuttle, for example in a zig-zag or similar arrangement. The weft thread is supplied before the respective shuttle enters into the shed, in contrast to other types of wave shed looms. Supplying the weft thread to the shuttle before it enters the shed has the advantage that, with constant circulation speed of all the shuttles, each one need be supplied with weft threads which have a length necessary for passing through only one of the sheds of one of the fabrics. Thus, the characteristics of the weft threads for each one of the fabrics can be selected as desired. Different characteristics may, for example, be different colored threads or the like.

In order to supply each one of the shuttles with the measured weft thread of finite length, it has been proposed to pull off measured pieces of weft thread from a supply package, for example a thread package, a pirn, or the like, measuring the length to be pulled off, and supplying the measured length to the injector. This supply must, of course, be synchronized with the movement of the shuttle past the injection station or, more exactly, the injection nozzle. In other words, the injection nozzles periodically supply suitable lengths of weft thread, timed with the movement of the shuttles past the injection nozzle.

U.S. Pat. No. 3,626,990 describes the basic arrangement of such an apparatus. The basic structure of a multi-system weaving loom, which may be in the form of a circular weaving loom or in form of a linear weaving loom with back-to-back construction, together with weft thread supply arrangements of the type to which the present invention relates are described in U.S. Pat. No. 3,749,135.

The weft thread supply device for machines of this type utilizes a continuously operating cylindrical or conical measuring drum which has a circumferential surface which is hardened. A pressure roller engages the drum. The pressure roller has an elastic coating, and is movable between a rest position, spaced from the drum, and an operating position in which it is in engagement with the drum, with the thread to be passed between the drum and the pressure roller. The thread is fed by the pressure roller in engagement with the drum at a clamping position. When the pressure roller and the drum are spaced from each other, the feed of thread is interrupted, for example by restraining movement of the thread by a thread brake, as well known. Such a thread brake, located in the path of the thread, is for example a double-disk thread brake which retains the thread at the inlet to the clamping position between drum and pressure roller under a predetermined continuous tension. The thread supply device for a multi-system is suitable to supply weft threads to a multi-system circular weaving loom, for example with progressing shed. The measuring drum, then, can be coupled to the rotor of the circular weaving machine, so that the circumferential speed of the measuring drum is synchronized with the movement of the shuttles through their circular paths. The shuttle path is coupled to an endless cam track of approximately the same diameter as the shuttle path, which is scanned by a cam follower and, over suitably shaped and journalled levers, controls movement of the pressure roller from a quiescent position in the operating or thread feed position, and back into quiescent position.

The diameter of the measuring roller, as well as the gearing between the rotor of the circular weaving loom and suitable shaping of the cam track permit synchronized operation and control of the time period during which the pressure roller is engaged with the measuring drum, so that the weft thread which is fed will have a precisely predetermined length, to be injected by the injector nozzle into the shuttle which passes in front of the nozzle. If it is desired to change the width of the fabric to be made, or to change the characteristics of the weft threads, the respective cams of the cam track must be changed to match. This is difficult and requires substantial time in resetting the machine, particularly if the cam track is in the form of an endless ring, and a plurality of weaving feeds or systems are arranged on the machine. Control of the pressure rollers of the thread supply device for a multi-system bilateral weaving loom in back-to-back construction is practically impossible by such an arrangement, since the shuttle, as it introduces the weft thread into the fabric, runs through an essentially straight path.

Another system is known in the industry, and described, for example, in German Patent Disclosure Document DE-OS No. 28 00 639. This system is specifically adapted for a circular weaving loom of the progressive shed type. It utilizes a continuously driven pair of rollers in which one roller can be lifted off the other in order to interrupt feed of a weft thread. Both rollers are so connected by an interengaging gearing that the surfaces which clamp the weft thread therebetween will have the same circumferential speed during the transport of the weft thread. A controlled thread brake is provided, positioned in the thread path in advance of the rollers, which can be so adjusted between an open and a braked position that it clamps or breaks the weft thread when the supply roller pair does not feed the thread, and vice versa. The supply roller which is movable with respect to the other is located on a carrier which can pivot about a pivot axis and is pressed against a camshaft, in which the carrier, simultaneously, can be used to open the thread brake. Both supply rollers are driven from the main drive of the circular weaving loom. The drive of the cam disk, itself, is not further described.

German Pat. No. 30 16 182 describes a method and apparatus for pneumatic introduction of a weft thread into a shuttle used in a multi-feed or multi-system double or bilateral weaving loom. The weft thread injector moves during introduction of the weft thread into the respective shuttle together with movement of the shuttle, in order to be able to introduce a longer weft thread in the time period available for introduction of the weft thread into the shuttle. The measured length of the weft thread is supplied to the injector through a supply system which has a driven drum and a pressure or engagement roller, supplying the weft thread to an injection nozzle. The measuring roller or drum operates at constant speed. The pressure roller is controlled by a gearing which receives drive power from a drive segment which is coupled to the drive segments which move the shuttles, by positive coupling or gearing. Such an arrangement is suitable because any gearing on the drive segments can be used to provide for synchronization of the movement of the injectors, and the gearing to cause movement of the injectors during supply of the weft thread is already present anyway.

The Invention

Briefly, it is an object to provide an arrangement or system or apparatus to repetitively and periodically supply measured lengths of weft threads for shuttles of a multi-system back-to-back weaving loom, in which precise synchronization of the weft threads is insured, while using a simple and reliable construction which does not require any additional complex operating elements on the weaving loom; and, preferably, permitting supply of not only one weft thread, but a selected one of a plurality of weft threads, for example of different color or otherwise different characteristics, while ensuring rapid and precise selection of the respective weft thread which is to be supplied.

Briefly, a positive drive, preferably a shaft-and-gear drive, is provided to couple a measuring drum as well as operating means for at least one pressure roller to the main shuttle drive of the machine which, also, controls the movement of the shuttles through the traveling sheds, to thereby obtain precise synchronism of injection of weft threads as the shuttles move past an injection position.

In accordance with a feature of the invention, a plurality of pressure rollers can be provided, one each associated with the respective weft threads and selectively engageable with the measuring drum. Each one of the pressure rollers is associated with an injection nozzle. The pressure rollers are spring-biassed towards the measuring roller, and retainable out of engagement by a locking element which can be unlocked under control of a control element, which may be an electrical solenoid or the like, to permit engagement of a selected one of the pressure rollers with the drum and hence feed the selected weft thread to the injection nozzle and to the shuttle moving past the injection nozzle. A common reset arrangement is provided coupled to all the pressure rollers to return the pressure rollers to the locked position after a weft thread has been injected. The reset arrangement is connected to and controlled by the main drive of the weaving loom and resets the pressure rollers when the shuttle, after having the respective weft thread injected therein, has moved past the injection nozzles, has received the predetermined length of the weft thread, and is ready to introduce the weft thread into the fabric to be made.

In accordance with a preferred feature of the invention, a positive drive is provided for the measuring drum and for the control elements which control engagement of the pressure roller, which positive drive, in turn, is driven from the main shaft of the weaving loom. The main shaft of the weaving loom, of course, also controls movement of the shuttles through the respective sheds.

The positive drive, in accordance with a feature of the invention, may be a direct drive or utilize an intermediate gearing which has a gear transmission ratio so selected that the connection to the measuring drum is simple while, simultaneously, permitting equally simple coupling to the operating elements for the pressure rollers. The pressure rollers themselves, for example, can be controlled by cams. The transmission ratio can be so selected that, as the shuttle moves along the injection nozzle while passing through its guide track, corresponds to one complete revolution of a control shaft. This has the advantage that the control element can easily be manufactured in form of a cam disk, with a simple and reliable cam follower arrangement.

The system can be used for a plurality of threads; the pressure rollers preferably are held in tensioned position so that they can move towards engagement, which permits rapid effectively sudden engagement of the respectively selected pressure roller with the measuring drum. This permits rapid feed of the weft thread, and the entire selection procedure or, for example, change of color of thread between sequential shuttles, requires only very short time intervals. The reset arrangement, after a weft thread has been inserted, resets all the pressure rollers into their quiescent or rest position so that each shuttle may be supplied with an individually selected weft thread as each shuttle passes the injection position.

Preferably, the level of the respective bias forces applied to the pressure rollers is individually adjustable, so that not only selected colors of threads, but also threads of different thickness or other characteristics can, selectively, be introduced into sequential shuttles.

DRAWINGS

DETAILED DESCRIPTION

Figure 1:
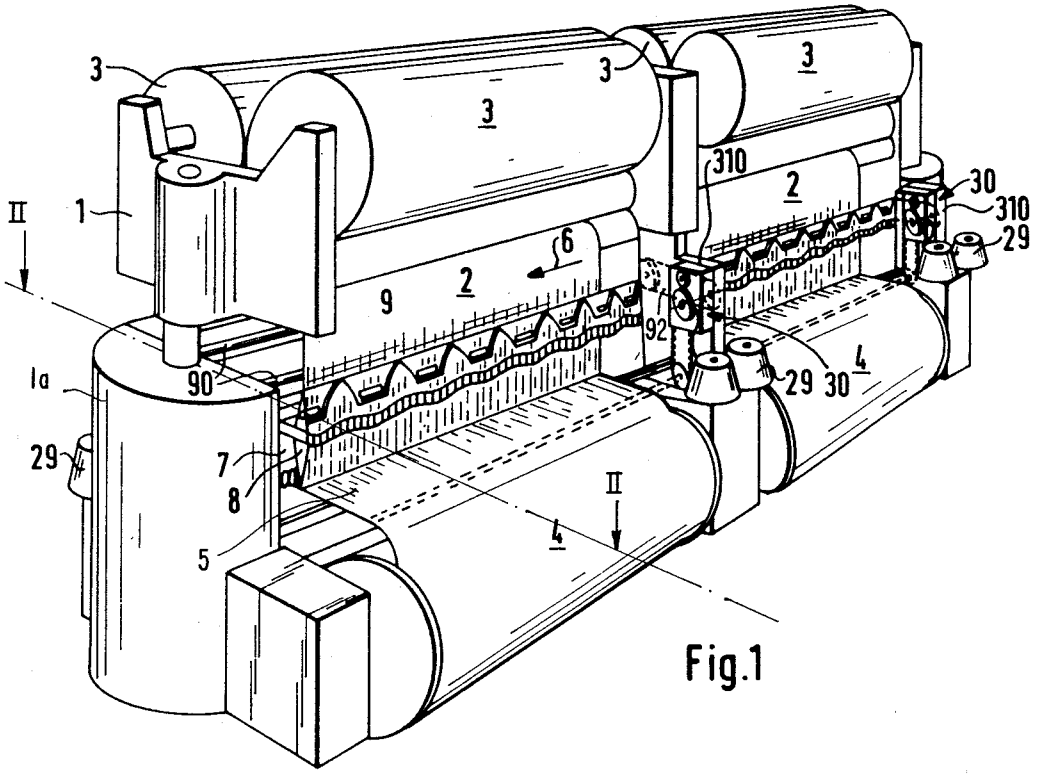
FIG. 1 is a perspective view of a multi-system weaving loom in back-to-back construction and including the subject matter of the present invention.

The multi-system weaving loom is constructed as a flat loom in back-to-back construction. It has a machine frame 1. It is constructed to permit simultaneous manufacture of four cloth webs 2. Each of the webs 2 is rolled up on a cloth beam 3, which is rotatably supported on a machine frame 1. Warp beams 4, likewise rotatably supported on the machine frame 1, provide warp threads 5 which are guided over suitable guide rollers. The warp threads 5 are moved alternately away from each other in a progressive movement in a direction of the arrow 6, transverse to the direction of the warp threads 5, to form sheds 8. A shuttle 9 is passed through each shed 8. The general construction of such a loom is well known, see for example U.S. Pat. No. 3,626,990.

Figure 2:
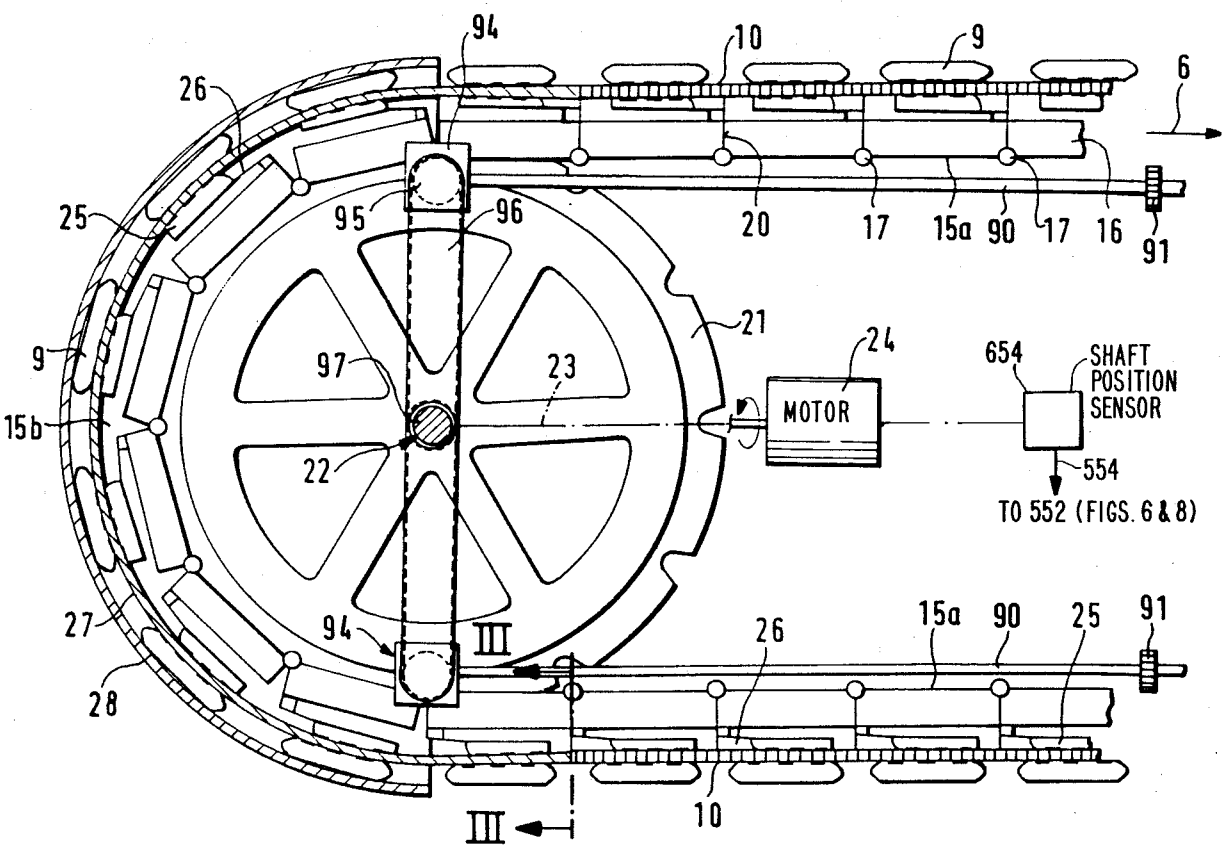
FIG. 2 is a fragmentary top view cut along a horizontal plane located at the line II—II of FIG. 1, and illustrating, in fragmentary representation, a portion of the shuttle path, including a curved return path, and of the drive system for the weaving loom.

The shuttles 9 run, one behind each other, in predetermined spacing as best seen in FIGS. 1 and 2, on a guide path which is formed on one side by a guide reed or guide leaf 10, and on the other side by the beating-up lamellae—not further shown—which permit further guidance of the shuttles 9. This structure, also, is well known and reference may be made for example to U.S. Pat. No. 3,049,135.

The guide path, along which the shuttle 9 runs, has two straight portions 15*a* (see FIG. 2) and two semicircular return portions 15*b*. The shuttles 9 are moved by shuttle moving elements or drive segments 16, also known as travelers, in the same direction. The travelers are coupled together or they may be secured adjacent each other to an endless chain. When the shuttles pass through the straight portions 15*a*, the travelers 16 may engage each other with their adjacent end surfaces 20; alternatively, they may be positioned spaced apart from each other.

The travelers 16, forming the drive or moving elements which are joined into an endless chain or an endless movable structure, are guided in the curved path portion 15*b* over sprockets 21, rotatable about vertical axes and secured to the machine frame. Only one sprocket is seen in FIG. 2. One of the sprockets, at least, is driven by a drive source 24 which, preferably, is an electric gear motor, via a drive connection 23 (see FIG. 2). The main loom drive shaft 22 and the sprocket 21 are connected, for example, by a spline or wedge connection. Upon rotation of motor 24, the travelers 16 will be moved in uniform motion in the direction of the arrow 6 (FIGS. 1, 2).

The machine frame may include a shroud 1*a*, covering the drive mechanism and protecting it against contamination, fluff and the like.

The respective travelers 16 are guided on suitable guide rails. On the lower side, facing the heddles 7, suitable cam tracks or control tracks are provided into which butts formed on the heddles 7, in well known manner, extend, to provide for synchronized operation of the heddles—as described in detail, for example, in U.S. Pat. No. 3,749,135, Linka, to which German No. 19 63 208 corresponds.

Each one of the drive elements or travelers 16 carries a drive part 25 at the side facing the guide track for the shuttles 9. The drive part 25 is forwardly bent, and is supported by a leaf spring 26 by the associated traveler, so as to be slightly movable with respect thereto. The leaf spring 26 presses the drive part 25 elastically against the guide reed leaf 10 or, respectively, against a curved guide rail 27 in the curved return path portion 15*b*, as best seen in FIG. 2.

Permanent magnet coupling is provided between the drive path 25 and associated shuttles 9, as described, for example, in detail in U.S. Pat. No. 3,618,640, to which German Pat. No. 17 85 147 corresponds. A guide rail 42, curved likewise in semicircular shape, provides for radial guidance of the shuttles 9 as they pass through the curved return portions 15*d* of their path.

Thread packages 25 supply weft threads to the respective shuttles before they enter the shed 8 of the warp threads 4. The packages 29 are shown only schematically; thread storage elements may be used therewith, for example located downstream, in the direction of thread feed, for the packages 29. They are supplied to an insertion unit (FIG. 1) which provides weft threads of accurately predetermined lengths.

The back-to-back double-sided multi-system weaving loom shown in FIG. 1 permits simultaneous production of four fabric webs 2. Four thread supply systems 30 are used, of which two, each, are located on one side of the machine. The thread supply devices 30 are located and suitably secured on frame portions 310 which, with respect to the direction of the arrow 6, are placed immediately adjacent to the right of the sheds between the associated warp threads 4. The shuttles 9 also move in the direction of the arrow 6. The arrangement is so made that the weft thread supply systems 30 are readily accessible from the operating side of the weaving loom and are not covered by the fabric being made or by the warp threads. They are, preferably, located immediately adjacent the respective thread supply packages 29.

Figure 3:
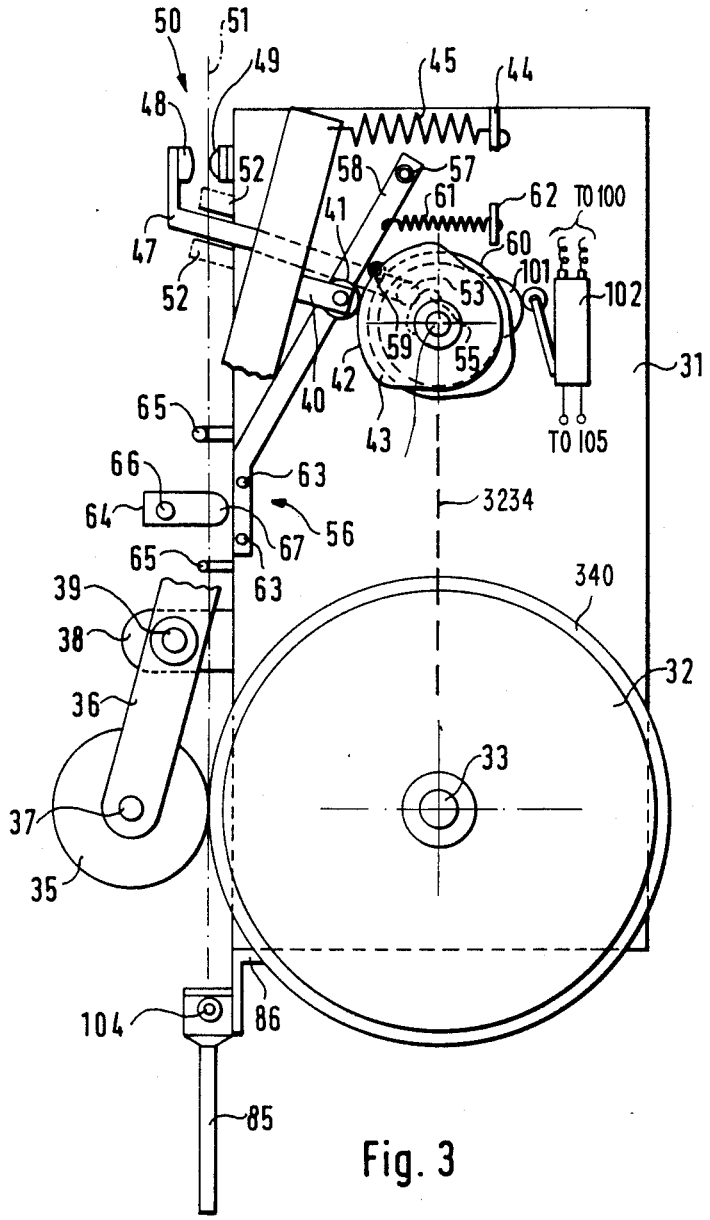
FIG. 3 is a front view of the weft thread supply apparatus for the weaving loom of FIG. 1, partly cut, and illustrating, schematically, only those components necessary for an understanding of the present invention.
Figure 4:
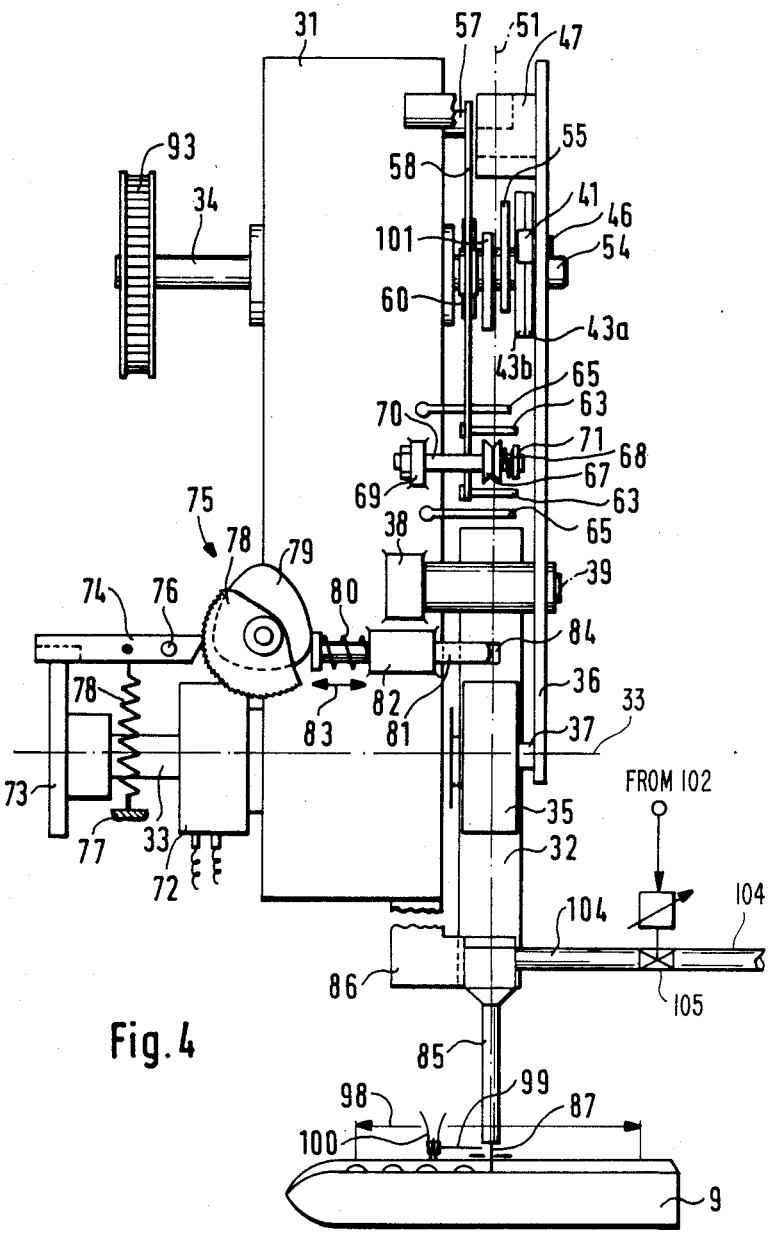
FIG. 4 is a schematic side view, partly cut open, of the apparatus of FIG. 3.

FIGS. 3 and 4, as well as FIGS. 5 through 9, illustrate the details of the construction of the thread supply systems.

A thread supply system, which is simple and adapted, for example, to supply a single type of thread, is best seen with reference to FIGS. 3 and 4.

An essentially square gear housing 31 rotatably retains a cylindrical or conical measuring drum 32, secured to a shaft 33. In accordance with a feature of the invention, the shaft 33 is positively coupled by a gear drive shown only schematically at 3234 with a drive shaft 34 (FIG. 4) extending parallel to the shaft 33. The drive shaft 34 is a main injector drive shaft and projects from behind the housing 31. The measuring and control gearing may be a gear or ribbed or toothed system, or cut gears which may include spur gears. The drum 32 is coated with a plasma sprayed coating, shown in FIG. 3 at 340. The thickness of the layer 340 is exaggerated in FIG. 3, for clarity of the drawing. The coating, at the outside, is rough and is made of a wear-resistant material in order to provide positive drive engagement with thread 51 passed between the coating 340 and a pressure or engagement roller 35. Other arrangements than a wear-resistant plasma-sprayed coating can be used, for example the surface of the drum or wheel 32 may be covered with a polished hard chromium coating.

The surface of the drum 32 cooperates with the pressure roller 35, which rotates about an axis parallel to the axis of rotation 33. The roller 35 has an elastic surface, for example of high-friction material. It is retained in a double-arm lever 36 by shaft element 37. Shaft 37 is pivotable about an axis 39 secured to a projection 38, attached to the housing 31, for example by welding. The lever arm of lever 36 above the pivot axis 39 extends towards the upper part of the housing. A projecting bearing element 40 retains a rotatable cam follower roller 41 which engages against a cam track 42 formed on a cam 43. The cam 43 is secured to the main injector drive shaft 34, to rotate with the measuring drum 32, and is attached to the shaft 34 at the forward end thereof. A tension spring 45, engaging the far end of the lever 36 and retained in a retention hook 44 secured to the housing 31, biasses the cam follower roller 41 against the cam surface 42.

The cam surface 42 can be formed of two cam disks. As best seen in FIG. 4, the first cam disk 43 is an expansion cam disk and is made of two part-cam disks **43*a*, 43*b*, which can be shifted with respect to each other by a shifting mechanism 46. Shifting the cam disks 43*a*, 43*b* with respect to each other changes the effective length of the cam surface 42 scanned by the cam follower roller 41** to permit, for example, extension of the scanned length.

An angled lever 47 is attached to the main lever 36, located, for example, roughly opposite the bearing element 40 for the cam follower roller 41. The angled lever 47 carries a brake shoe 48 at the other end, which is in operative association with the fixed brake shoe 49 of a controlled thread brake 50 for the weft thread 51, derived from the thread package 29 (FIG. 1). The thread brake 50 is located in the path of the thread 51 in advance of the measuring drum 32. In the open position, shown in FIG. 3, it provides for unimpeded passage of the thread 51 to the circumference of the measuring drum 32. When the brake is operative, it clamps the two brake shoes 48, 49 against each other under the tension derived from the spring 45, to clamp the thread 51 so that the thread 51 is retained in fixed position in the apparatus.

Various operating arrangements may be used; for example, a second cam 55 may be located on an extension 54 of the shaft 34. For better visualization, a scanning roller 53 as well as the cam disk 55 are shown in broken lines. A suitable spring maintains the roller 53 in engagement with the cam 55. Another arrangement permits placement of a second and independent brake, to provide for spaced holding of the thread 51, for example by locating a second arm (not seen in FIG. 3) behind the arm 47 and guided by two guide projections 52, the second arm then being angled over and holding the thread between two clamped shoes, of which one, coupled to the cam follower 53 or to arm 36, is movable and the other, like the back-up shoe 49, is secured to the housing 31. Since the spaced second brake can be identical to that described, it is not further shown in the drawings.

A thread draw-back device 56 is provided in the region of the thread path in advance of the measuring drum 52. This thread draw-back device permits pull-back of the thread by a predetermined distance counter the direction of the thread running movement when the brake is closed, that is, clamps the weft thread 51.

The thread pull-back device 56 is formed by a thread engagement arm 58, pivoted in the housing 31 at a pivot point 57. The pull-back arm 58 has a cam follower roller 59 secured thereto which scans a third cam disk 60. A spring 61, held at a counter hook 62 secured to the housing 31, retains the arm 58 in engagement with the cam disk 60.

The lower portion of arm 58—FIG. 3—has two spaced parallel pins 63 secured therein, forming thread guide elements, which are in operative association with a thread clamp 64. The thread clamp 64 is located between two hook-like thread guide bails 65, secured to a side wall of the housing 31. The thread clamp 64 is formed of two leaf springs 68, bent in conical or funnel shape, and seated on a bolt 70. They are pressed against each other by a spring 71 (FIG. 4), to form a clamping position for the thread 51, by resiliently engaging the leaf springs 68 against each other. The end portions 66 of the springs 68 are connected together, and the other ends 67 form the conically shaped parts. The bolt 70 is secured to the housing 31 by a bracket 69.

The clamping position for the thread 51 of the thread clamp 64 is outside of the path of the thread 51 determined by the thread guide eyes 65 (FIG. 3). When the thread brake 50 (FIG. 3) is open, the path of the weft thread thus is not impeded. If the thread arm 58 is pivoted about pivot 57, however, in clockwise direction, with reference to FIG. 3, the two pins 63 at the sides of the clamp 64 are moved towards the left, so that the portion of the weft thread 51 is introduced into the clamping position of the clamp 64. Upon return of the arm 58 into its quiescent position, the thread 51 is returned, due to its tension, again into the straight path and out of clamping relation from the clamping point of the clamp 64.

An electromagnetic brake 72 is located on the drive shaft 33 of the measuring drum 32 at the back side of the housing 31. Under ordinary operation, the brake 72 is not effective. It is engaged if the weaving loom should be stopped, and particularly if it should be suddenly stopped, in order to absorb kinetic energy stored in the rotating measuring drum 32, and thus prevent excessive loading of the measuring and control gearing within the housing 31.

Shaft 33 is coupled, further, to a cam wheel 73 which operates a ratched latch 74 of a laterally moving two-and-fro oscillating apparatus 75.

FIG. 4 shows the lateral scanning arrangement which prevents wearing of a groove into the drum 32 and the pressure roller 35. The apparatus 75 includes the latch arm 74 which is pivoted at a pivot shaft 76 and is retained in engagement with the cam 73 by a spring 77, secured to a suitable attachment coupled to the housing 31. The latch arm 74, upon moved upwardly and downwardly, with respect to FIG. 3, rotates a toothed cam wheel 78, in steps. The cam wheel 78 is secured to rotate with a cam 79. A thread guide arm 81 is in engagement with the cam 79, and spring-pressed thereagainst by the spring 80. The thread guide arm 81 is slidable in a guide eye 82, and moves the arm in the direction of the arrow 83 between the right and left positions, with respect to FIG. 3. The arm 81 carries a guide eye 84 through which the weft thread 51 is passed. Upon continued rotation of the drum 32, and considering the latch arrangement of latch arm 74 and toothed wheel 78, the thread guide arm 81 receives a movement which is to-and-fro, so that the thread guide eye will be moved between the right and left portion of the drum, and thus axially shifted about the circumference of the drum 32. This oscillating reciprocating movement prevents formation of a groove in the circumference of the drum 32 and thus prevents damage of the drum 32 by formation of grooves or ridges or other surface discontinuities.

A pneumatic thread injector 85 is located downstream of the drum 32, in the direction of weft thread movement, secured to the housing 31 by a holding arm 86. The pneumatic injector injects the thread into a shuttle 9, passing in front of a nozzle 87 of the injector, in order to insert a weft thread of predetermined length, as explained in detail in U.S. Pat. No. 3,626,990, which shows injection of a weft thread from the side into a laterally open shuttle.

The weft thread supply systems 30 are driven directly from one of the two main shafts 22 (FIG. 2) of the machine, which, also, drive the shuttles 9. Two parallel shafts 90 are located on both sides of the machine (FIG. 2), one each being used to drive the respective weft thread supply systems 30 on the respective sides of the machine. Each one of the shafts 30 carries a drive gear 91 (FIG. 2) which is coupled by a gear belt 92 with the gear belt disk 93, splined to the drive shaft 34 of the respective thread supply apparatus or system. The two shafts 90 operate at the same speed. Each one is driven from the respective shaft 22 by an intermediate gearing 94, which is coupled by a gear belt wheel 95 and a gear belt 96 to the associated main shaft 22 by a gear belt wheel 97, splined to the shaft 22. The transmission ratio of the intermediate gearing 94 and each one of the transmission belt systems 91, 92 (FIG. 1), 93 (FIG. 4) are so selected that the drive shaft 34 of the associated thread delivery system 30 carries out a complete revolution when the shuttle 9, to be charged by a thread 51, moves in front of the injector nozzle 87 (FIG. 4) of the associated injector 85 throughout the length of its thread reception chamber, shown by the dimension line 98 in FIG. 4.

A cutter apparatus 99 (FIG. 4) of any suitable and well known construction, and electromagnetically operated by an electromagnet 100, is placed and suitably supported close to the injector nozzle 87 to permit cutting the injected thread when the injection is terminated. The electromagnet 100 can be controlled in any suitable manner, for example by a fifth cam disk 101 located on the shaft extension 54 of shaft 34, which operates an associated switch 102 (FIG. 3).

Operation

Supply of weft threads to the shuttles 9, as they move in front of the injection nozzles 85, is obtained in this way:

When the shuttles 9 are located outside of the respective sheds of the associated warp threads 4, so that the leading end of the shuttle 9 is located beneath the end of the injection nozzle 87 of the injector 85, the first cam disk 43 which is constrained to operate in synchronism with the movement of the shuttle 9, causes lever 36 carrying the pressure roller 35 from a quiescent, spaced position to engage the circumference of the measuring drum 32, as shown in FIG. 3. Synchronized operation of the shuttle, of the measuring drum and of the pressure roller 35 is obtained by the positive gearing by the shafts 90 (FIG. 2) from the main loom drive shaft 22, which also causes movement of the shuttles via the travelers 16, and gear belts and associated pulleys 91–93 and shafts 34, coupling 3234, and shaft 33. In the engaged position between the pressure roller 35 and drum 32, the thread is fed and rapidly, abruptly accelerated at the clamping position between the drum 32 and the pressure roller 35, and suddenly and abruptly supplied to the injector 85. The injector 85, receiving compressed air, pneumatically injects the thread into the storage area of the shuttle 9 due to the relative movement of the shuttle 9 with respect to the injector 85. As the pressure roller 35 engages the circumference of the drum 32, the thread is automatically and simultaneously removed from the thread clamp 64. The pivoting movement of the lever 36 which carries the pressure roller 35 likewise releases the brake 50.

The diameter of the drum 32 and the transmission ratio of the gearing within the housing 31 is so selected that, in the period of time in which the pressure roller 35 is pressed against the measuring drum 32, under action of the first cam disk 34, a predetermined length of weft thread is inserted into the shuttle 9, accurated determined in its length.

As soon as the shuttle 9 has thread supplied thereto, and leaves the region of the injection nozzle 87, the first cam disk 43, synchronized with the movement of the shuttle by being coupled to the shaft 34, causes pivoting of the lever 36 in clockwise direction, with reference to FIG. 3. This lifts the pressure roller 35 off the circumference of the drum 32, thus stopping engagement of the thread with the drum 32 and hence the feed of the thread in the direction of the shuttle. Additionally, thread brake 50 closes, and clamps the thread 51 on the path to the drum 32. This prevents supply of uncontrolled length of the weft thread to the injector 85. The cutter 99 has, of course, also severed the lower end of the weft thread introduced in the shuttle 9.

The leading end of the shuttle 9, in the meanwhile, may have entered the associated shed 8 and begins insertion of the weft thread.

As soon as the weft thread 31 cut by the cutter 99 has been cut, the second cam disk 60 causes the thread retention arm 58 to pivot in clockwise direction, with respect to FIG. 3, so that the weft thread 51, already held in the brake 50 in its path from the package 29, is introduced into the clamp 64 and thereby pulled back from the injector 85 sufficiently to permit retraction of the end of the weft thread 51 from outside of the injector, while retaining its end within the injector 85, preventing, however, projection beyond the end of the injector nozzle 87.

At the same time, or shortly thereafter, a further cam or cam 101 on the shaft 34, or the extension 54, whichever is desired, engages a further pair of contacts of the switch 102 which so controls a valve 105 (FIG. 4) included in the compressed air supply 104 of the injector 85 that the compressed air supply to the injector 85 is inhibited or at least throttled. This prevents damage to the free end of the cut thread 51 due to the relatively high flow velocity of the air stream surrounding the thread 51, and thus prevents formation of uncontrolled fringed end portions.

The drive shaft 34 as well as the main shaft 22 of course continue to rotate during this entire operation. As soon as the thread supply of the subsequent shuttle 9 enters the region of the injection nozzle 87, the cam disks 43, 55, 60, 101, 103 on the control shaft 34 or 54, respectively, start a new operating cycle to supply the next measured weft thread piece.

The thread retention arm 58 can be placed in its quiescent or full-line position shown in FIG. 3 immediately after it has clamped the thread in the clamp 64. For insertion of the next thread, the throttle valve 105 is opened, brake 50 is opened, and the pressure roller 35 again moved in its engaged position. Of course, the yarn retraction arm 58 previously has been transferred into its quiescent position.

The thread supply device 30, and the drive therefor, was explained in detail in connection with a double-sided back-to-back multi-system or multi-feed weaving loom; of course, the system is equally suitable for other types of weaving looms, and for example in combination with a circular weaving loom.

The length of the engagement interval of the pressure roller 35 at the circumference of the drum 32 can be controlled by suitable adjustment of the length of the cam surface 42 of the expansion cam 43. Similarly, the other cams 55, 60, 101, 103 can be formed of double-cam disks, suitably shaped to permit extending the cam surface or shortening it, as is well knowm. It is also desirable to permit relative circumferential or angular adjustment of the respective cam disks on the control shaft 54, or the main shaft 34, respectively, so that precise timed control of the various control functions, as determined by the cam lands, is possible.

The cam disks 43, 55, 60, 101, 103 may all be secured to the extension 54 of the common drive shaft 34. Other arrangements, of course, can be used, in which separate shafts are provided for various cam disks, provided they are coupled by positive drive gearing with the shaft 34. Thus, individual shafts may be located within the housing 31 for the various functions to be carried out, in timed synchronism.

The main shaft 22 (FIG. 2) is used to provide the main drive for the sprocket 21. Other main shafts may be used, and, for example, the main shaft of the machine may be considered as the shafts 90. Thus, other main shafts may be used, provided that the drive of the shuttles in their paths and the supply of the weft thread are synchronized. Thus, other arrangements to couple movement of the shuttles 9, for example controlled by the shaft 22, and the respective yarn supply systems can be used.

The arrangement is particularly suitable since it permits compact construction in which all elements to supply the weft threads are located on a single housing.

The connection between the shaft 33 for the measuring drum 32 and the shaft 34 coupled to the gear belt 92 (FIG. 1) can be constructed in any suitable manner, for example by a simple gear belt, dual bevel gears or the like. Since any suitable construction can be used, the connection is shown only in schematic form by a broken line 3234 in FIG. 3.

In accordance with a feature of the invention, the arrangement can readily be adapted to supply a plurality of threads of different characteristics, for example of different colors, to the injector.

Figure 5:
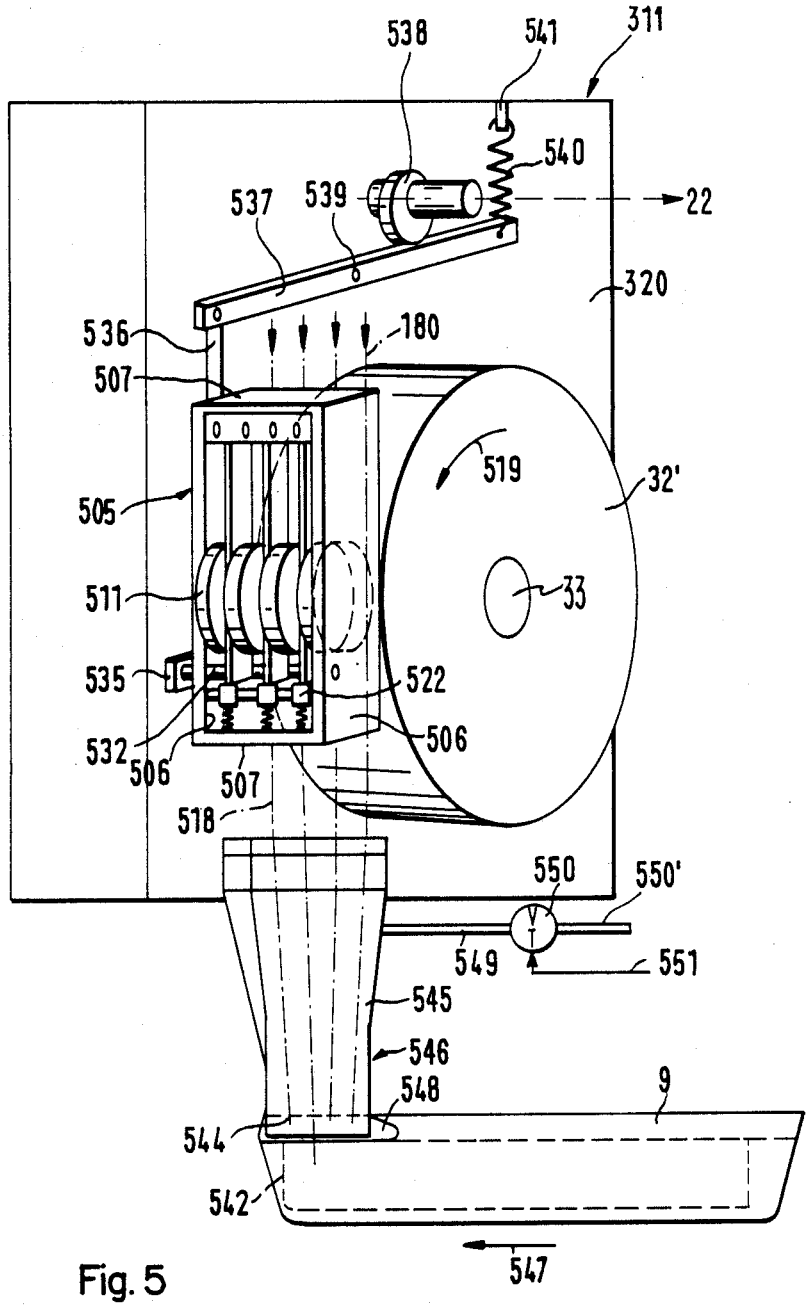
FIG. 5 is a schematic perspective view of a weft thread supply apparatus to feed a plurality of weft threads to the loom of FIG. 1.

Referring now to FIG. 5: Measuring drum 32' which, preferably, is axially extended to accommodate a plurality of threads 180 adjacent each other, is secured in a suitable housing 31' having a front wall. The measuring drum 32' is coated, as before, with a sprayed coating 340, shown in FIG. 7 with excessive thickness for clarity. The measuring drum 32' is coupled to the drive shaft 33, only shown schematically in FIG. 5 which, in normal operation of the weaving loom, provides for continued rotary movement of the drum 32 or 32'.

An essentially rectangular frame 505 is located in front of the housing wall 320. The frame 505 has two parallel side walls 506 and two parallel end walls 507. A cylindrical shaft 508 is retained between the side walls 506 on which four double-arm levers 509 are pivoted. The levers 509 extend parallel to each other, and are maintained in spaced position by spacers 510, to be guided laterally, and form bearing elements for disk-like cylindrical pressure rollers 511, which correspond to the pressure rollers 37 (FIGS. 3, 4). The pressure rollers 511 have an elastic surface and, in accordance with a feature of the invention, can be selectively engaged with the circumference of the measuring roller 32'. The arrangement is so made that each one of the levers 509 carries the associated pressure roller 511 on a shaft 512, secured to the respective lever 509, and on which the pressure roller 511 can be moved. The respective levers 509 are maintained in spaced position from the measuring drum 32' by a spring 514, coupled to the far end 513 of the levers 509, and secured to a back wall of the rectangular housing formed by the elements 506, 507. The springs can be individually adjusted by being hooked into a threaded spring bolt 515 passed through an extension 516 on the rectangular frame 506, 507 and secured in position by a nut 517. Upon suitable adjustment of the nut 517, the engagement force of the respective lever 509 can be individually adjusted.

The springs 514 have the tendency to move the levers 509 in counterclockwise direction about the shaft axis 508, with reference to FIG. 3. The associated pressure roller 511 is then pressed against the circumference of the drum 32'. A weft thread 518, derived from a thread package 29, is then engaged at the clamping position between the respective pressure roller 511 and the drum 32'. Drum 32' operates in the direction of rotation indicated by the arrow 519, to move the respective thread 518 downwardly, with respect to FIG. 7.

Figure 7:
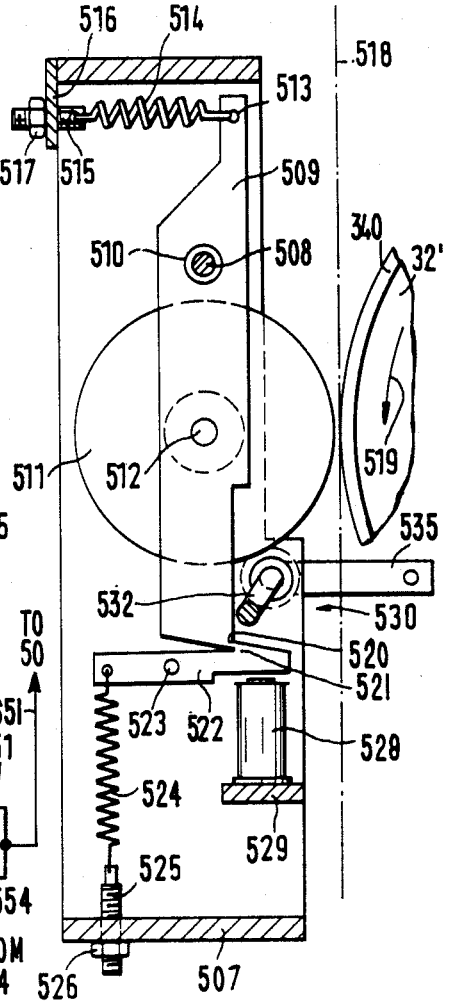
FIG. 7 is a side view of the apparatus of FIG. 6, cut along the line VII—VII of FIG. 6.

The pressure rollers 511 are singly and separately controlled between quiescent or ineffective positions, as shown in FIG. 7, in which they are spaced from the circumference of the drum 32', or in engagement with the drum 32', to supply the respective weft thread 518. Individually controllable operating elements are associated with each of the levers 509.

Figure 6:
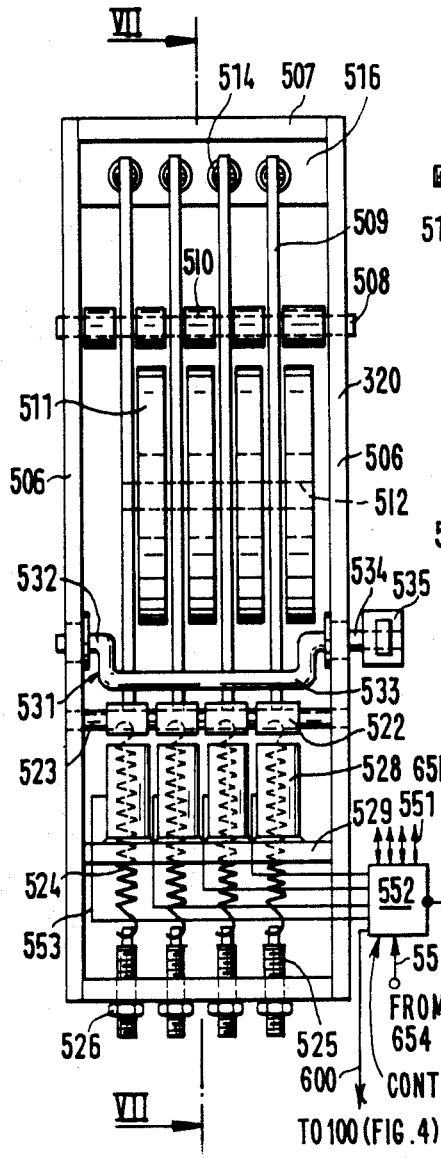
FIG. 6 is a front view of the apparatus of FIG. 5.

To permit individual control of the respective levers, it is possible to associate each one of the levers with an individual cam 43 (FIG. 3) and either engage or disengage the respective cam, or engage or disengage a respective cam follower. In accordance with a feature of the invention, however, and as best seen in FIGS. 5 to 7, the individual levers are locked in disengaged or quiescent position by engaging the end of the respective levers 509 in a latch 520 which cooperates with an engagement shoulder 521 formed on a latch lever 522.

The latch levers 522 are located on a common horizontal pivot axis 523 for individual pivoting movement. Pivot shaft 23 is rotatably retained in the side walls 506. At the end remote from the latch 520, 521, the individual levers 522 are retained under tension by springs 524 secured by tensioning bolts 525 to the bottom wall 507. Bolts 525 are individually adjustable by nuts 526. The springs 24 have the tendency to hold the latch levers 22 in engagement with the latch ends 520 of the levers 509, so that the individual pressure rollers 11 are locked in quiescent, disengaged position.

Each one of the latch levers 522 has an electromagnet 528 located adjacent an end portion close to the latch shoulder 521. The respective electromagnets 528 are solenoids, operating as pull magnets which, upon energization, pull the respective latch 522 downwardly, to pivot the latch 522 in clockwise direction, with respect to FIG. 7, about the shaft 523, and thus release the associated lever 509 with the associated pressure roller 511. All solenoids 528 are secured on a common bracket 529, coupled to the side walls 506, for example by welding.

In accordance with a feature of the invention, a common reset mechanism 530 is provided which can reset all the levers 509 for latched position in the latches 522. Of course, it is contemplated that only one of the levers 509 is unlatched. By providing a common reset mechanism, however, any one of the levers 509, regardless of which one had been selected, is being reset by a single reset command.

The reset arrangement 530 includes a common reset element 531, engageable with any one and all of the levers 509.

In the embodiment of FIGS. 5 to 7, the reset element 31 is a reset bail 32, rotatably supported for horizontal rotation in the side walls 506. The bail 532 has an offset engagement portion 533 which spans across the respective levers 509, as best seen in FIG. 6. The reset bail 32 is preferably made of a cylindrical wire or bolt element, and coupled to an operating lever 535 from a point extending beyond one of the side walls 506. As best seen in FIG. 5, the lever 535 can be raised by pivoting about the bearing of the bail 532 in the side walls 536 upon raising of lever 536, coupled to a lever 537 and pivotable about a pivot axis 539, under action of a cam 538. The lever 537 is maintained in engagement with cam 538 by a spring 540, hooked into a hook 541 on the frame 31'. The lever 535 and the bail 532 are securely coupled together so that the bail 532 will rotate upon movement of the link-lever connection 535, 536, 537.

Pivot 539, pivotably retaining pivotable lever 537, is secured to the front wall 320 of the housing frame 31'. The spring attachment 541 is suitably attached to the housing 31'.

The cam 538 is coupled to the main drive of the weaving loom, for example by a gear belt parallel to, or driven in synchronism with the gear belt 92; or driven from the main shaft 33 which also drives the measuring drum 32'. The coupling between the cam 538 and the measuring drum 32' is so geared that the cam 539 carries out a complete rotation through 360° in the period of time that the storage region 542 of a shuttle 9 passes in front of injection nozzle openings 544 of the injector 545. The shuttle 9 moves in the direction of the arrow 547. The drive to the shaft of the cam 538 has been omitted from the drawing since it can be standard and in accordance with any suitable connection. As in the embodiments of FIGS. 1–4, the drive of the shaft 538 is synchronized with the drive of the shuttles 9.

Figure 8:
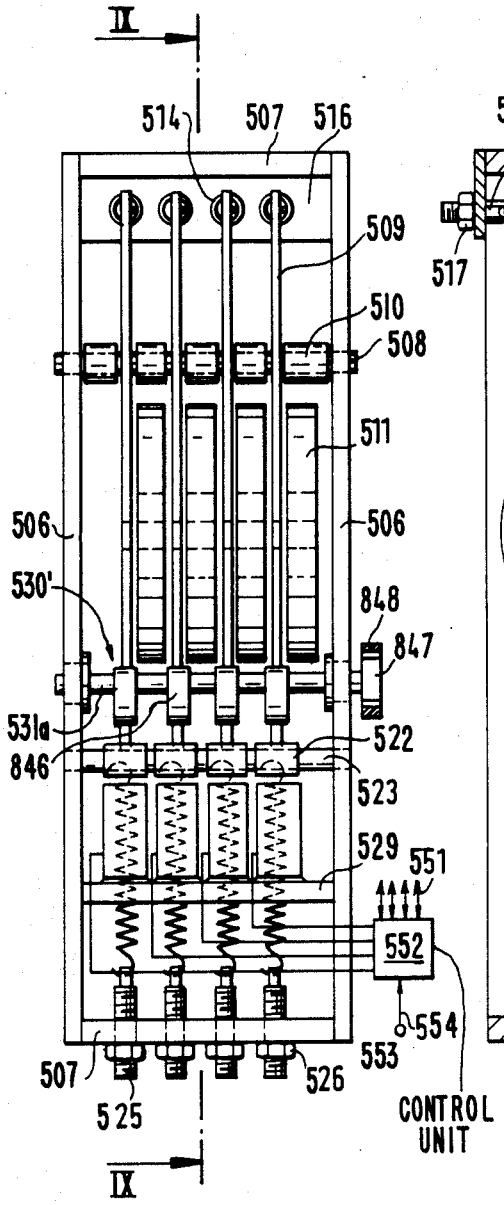
FIG. 8 illustrates another embodiment of a weft thread feed apparatus, shown similar to the embodiment of FIG. 6.
Figure 9:
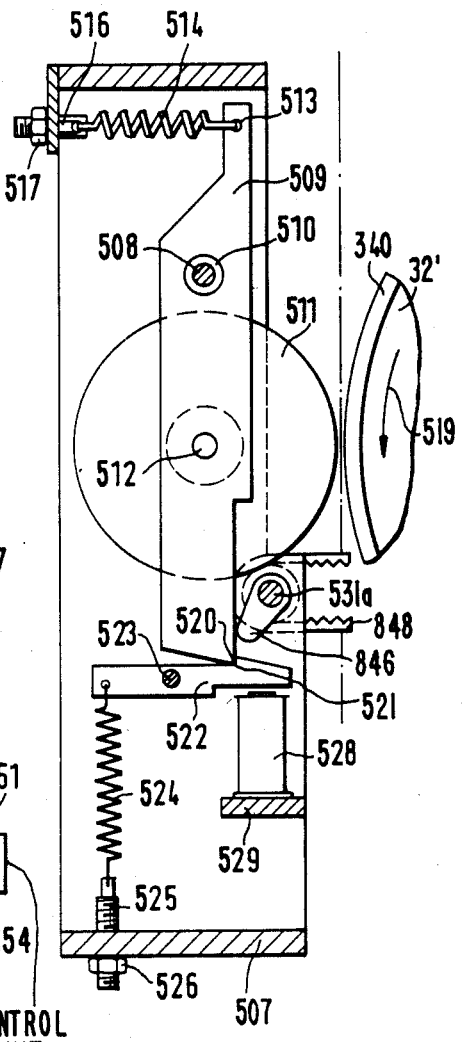
FIG. 9 is a schematic side view of the apparatus of FIG. 8, cut at the section line IX—IX of FIG. 8.

FIGS. 8 and 9 illustrate an alternative embodiment, in which parts already discussed and which are similar have been given the same reference numerals. The basic difference between the embodiment of FIGS. 8 and 9 and that of FIGS. 5 to 7 is the reset arrangement 530'. The reset arrangement 530' uses a cam shaft 531*a*, on which individual cams 46 are located, associated with each one of the levers 509. The cam shaft 531*a* is securely connected to a drive wheel 847, to rotate therewith. The drive wheel 847 is located outside of the adjacent side wall 506, and is in engagement with a gear belt 848. Gear belt 848 is driven in synchronism with the movement of the shuttle 9, as illustrated before, for example by being in positive drive connection with the shaft of cam 538, and/or the drive to the measuring drum 32'. Each one of the pressure rollers 511 are associated with an individual weft thread 18. In the embodiment illustrated, four weft threads 18 are located adjacent each other, distributed over the width of the circumference of the measuring drum 32'. An individual injector 545 is provided for each thread—as illustrated in FIG. 5—and the injectors are combined together in an injector block 546; alternatively, they may be integrated in a single block, with different injection openings, to form injection nozzles 544. Preferably, a guide projection 548 extends from the block 546. The guide projection 548 is wedge-shaped and may be used to operate a thread brake which can be secured to the shuttle 9, to engage the thread brake or clamp as the shuttle 9 moves past the injector 546, as known.

The basic structure of an injector 545 is known, see, for example, U.S. Pat. No. 3,626,990. Compressed air is supplied to the injectors as indicated schematically in FIG. 5 by a compressed-air line 550', controlled by a control valve 550, for example as described in connection with FIG. 1. The control valve 550, preferably, is electrically operated and is constructed in form of a magnetic valve. The control valves 550, one for each one of the injectors 545 or, respectively, the injection ducts or nozzles 544, are controlled individually over lines 551 from a program control unit 552 (FIG. 6). Control unit 552 may be any well known computer controller which is capable of controlling the respective valves in accordance with a timed sequence or pattern. The control unit 552 has output control connections 553 which control the operating magnets 528 of the respective latches 522. Input information can be applied to the control unit 552 over an input connection line 554 which permits the introduction of feedback information representative of the position of the shuttles 9 in their path before and in front of the respective injectors 545.

Operation

In quiescent position, all the pressure rollers 511 are in the rest position in which they are spaced from the measuring drum 32', that is, are in the position of FIG. 7 or 9. They are latched in rest position by the associated latch levers 22, and retained by the springs 524. The pressure rollers 11 are lifted off the circumference of the measuring drum 32', so that no supply of a weft thread 518 will take place. Yet, all the levers 9 are elastically biassed towards the measuring drum 32' by the respective springs 514. Springs 514 and the levers 509 tend to push the rollers 511 towards the measuring drum.

The reset arrangement 530, 530' is out of operation. The respective reset elements 531, 531*a* are in a position which does not interfere with pivoting movement of the respective levers 509 about their pivot axis 508 in counterclockwise direction, with reference to FIGS. 7 and 9.

When a shuttle 9 arrives in the position such that its storage region 542 is below an injector nozzle 544, the programmed control unit 552 receives the appropriate information to trigger release of the lever 509 of the respective pressure roller 511 associated with the selected weft thread 518. The control unit 522 then, over the appropriate connecting line 551, selects that one of the magnets 528 which can unlatch the lever 522, releasing lever 509 associated with the selected weft thread 518, in order to supply the respective weft thread to the associated injection nozzle. At the same time, or even slightly before, the injector 545 associated with the selected thread receives a command to open the respective valve 550 and apply compressed air from line 551, so that the respectively selected injector associated with the selected thread receives full compressed air pressure and supplies the weft thread into the storage region 542 of the shuttle 9.

As soon as the latch 522 has been released, by pivoting in clockwise direction (FIGS. 7, 9) under magnetic force upon energization of the respective solenoid 528, latch 521 releases the latching corner 520 of the associated lever 509 so that its spring 514 can abruptly engage the pressure roller 511, associated with the thread of the selected color, against the measuring drum 32'. The roller 511 is in engaged position.

The selected thread 518 is delivered through the injection nozzle 544 into the storage area 542 of the shuttle until the shuttle begins to leave the injection nozzle region. At that point, the shaft of the cam 538 (FIG. 5) has rotated over such an angle that the link and lever connection 536,537,538 rotates the bail 531 to engage the bail with the respective lever 509 to lift the roller 511 off the measuring drum 32' and thus terminate supply of a weft thread. In the embodiment of FIGS. 8 and 9, reset is effected by coupling the rotary movement of the main shaft, through a suitable gearing or gear belts, to the gear belt wheel 547 and rotating the respective cams 546, which can all have the same cam shape, thereby resetting the previously selected lever 509 into the latched rest position shown in FIGS. 7 and 9. In all other respects, the operation is the same in both embodiments.

As soon as feed of the respective thread 518 is interrupted, the control unit 552 engages a suitable thread brake, not shown, and for example of any well known construction over line 651 positioned in the path of the thread from the package 29 to the measuring drum 32, and located, for example, as described in connection with FIGS. 1–4. The associated valve 550, likewise, is controlled to so reduce the compression level of the compressed air supply that the thread is maintained in somewhat stretched condition without, however, being of such magnitude that the now stationary thread can be untwisted or the end subject to fringing or damage. Thus, sufficient residual air flow can be maintained through the injectors merely to maintain the thread in straight position without, however, substantially straining it or causing any damage.

As the reset bail 532 continues to move towards the levers 509, and engages the previously projected lever 509, the lever 509 will snap behind the latch shoulder 521 of the associated latch lever 522 with the latch tooth 520 of the lever. In a terminal position, it is preferred to so move the respective reset arrangement 531 or 531*a* that all the levers 509 are moved slightly behind the latch, that is, all the levers are lifted off engagement with the latch projections 521. This ensures reliable holding and, by suitable selection of the geometry of the latch lever 522 and the projecting end of the levers 509, it can be easily ensured that the respective latch lever 522 automatically snaps into latching position under tension of the associated spring 524, while just prior thereto having deflected counter the tension of the spring 524. Preferably, the forward portions of the levers 522 and the rearward portions of the levers 509 form inclined surfaces which ensure that the latch levers 522 can deflect counter the tension of the respective springs 524 by the required distance before the latches 520, 521 engage.

Upon continued rotation of the reset arrangement 531, 531*a*, respectively, in clockwise direction with reference to FIGS. 7 and 9, the reset arrangement again releases the respective latch levers which, now, are all locked by the latches 520, 521 with the respective levers 522, so that they are available for selection of a new weft thread.

The diameter of the measuring drum 32 or 32', and the speed as well as the length of time during which the respective pressure rollers 11, 511 are engaged with the measuring drum are so matched to each other that a precisely measured length will be supplied during engagement of the respective pressure roller 511 against the measuring drum for supply by the injectors 45 into the storage region 542 of the shuttle beneath the injector.

The pressure rollers 35, 511 are freely rotatable on their respective levers 36, 509. In accordance with a modification, it is also possible to provide a drive engagement for the respective pressure rollers 35, 511, so that they can be driven with the same circumferential speed as that of the associated measuring drum 32, 32'.

Control of the respective engagement of the rollers 35, 511 can be effected mechanically (FIGS. 3, 4) or electrically (FIGS. 5–9). The mechanical control by means of a plurality of cams is simple and reliable, the cams permitting simultaneous control of the respective pressure roller 35 and the thread brake. Cutter 99, 100, shown in FIG. 4, has been omitted from the illustration in connection with FIGS. 5 and 9 for clarity. The thread retention apparatus which is operated by lever 58 (FIG. 3) permits clamping of a thread and complete shut-off of compressed air through the injector nozzle. The arrangement is particularly simple when controlled by an additional cam or cam track on a main control cam arrangement, as explained in connection with FIG. 3. After introducing the thread into a temporary holding structure, for example formed of two dished disks which are spring-pressed against each other, they can be easily fed by the engaged rollers 32, 35. Alternatively, the retraction system can be omitted and a small amount of air flow maintained through the injectors. Of course, the thread can be clamped while maintaining some air flow around the injectors, which has the additional advantage that the thread to be injected is maintained straight in the injectors.

The thread supply apparatus of the present invention is preferably secured to a support plate or chassis plate so that the respective elements are easily accessible. This is particularly important for the various cams 43, 55, 60, 101, for example, and especially if the cams are constructed as two-part elements so that they can be precisely adjusted on the respective shafts 54 or 34 for timing as well as setting the thread length. Of course, similar effects can be obtained electrically by simple setting of the control unit, for example by controlling the timing of the latch release and a reset operation.

Various changes and modifications may be made, and features described in connection with any one of the embodiments may be used with any of the others. For example, the cams illustrated in FIGS. 3 and 5 may be scanned electrically or pneumatically, and need not be scanned only by cam follower rollers. Electrical or pneumatic operating elements are then associated with the respective cams. For example, the cams can operate mechanically controlled electrical switches, or mechanically controlled pneumatic valves. Contactless scanning elements, for example optical gates, air jets and the like, may also be used.

It may happen that due to malfunction in the weaving loom, it is necessary to rapidly stop the loom. The measuring drum 32, 32' is comparatively large and will have considerable inertia. The drive to the measuring drum preferably is a precision drive so that the thread injection and movement of the shuttle can be precisely synchronized. To prevent excessive loading on such a precision drive, a brake, which may for example include a clutch to permit disengagement of the drum 32, 32' from the machine drive, with precisely angularly controlled re-engagement, of course, is desirable. At least, the brake should stop the drum apart from the stopping of the remaining weaving operation, and the brake coupled to the drum, see for example brake 72, should be rapid-acting and of sufficient capacity to rapidly absorb the kinetic energy of the rotating drum 32, 32'.

The thread supply device preferably is constructed in modular form, in which at least the measuring drum and the pressure roller, or pressure rollers, forms one module which is separable from the remainder of the thread supply system. The other units, such as the thread retraction system 56 (FIG. 3), the thread brake 50, or the thread selection unit 505, can then be constructed as separable units for ease of replacement. This permits particularly compact construction, and building these elements as separate units which can be individually separated from the housing or frame results in an especially compact overall system.

Retaining a plurality of pressure rollers 35, 511 on a lever which is pivotable about a common shaft results in an especially compact construction in which the individual engagement pressures of the respective rollers, additionally, can be individually adjusted by individual tensioning springs 514 (FIGS. 7, 9). Of course, a plurality of levers 36, retained by individual tension springs 45 which, likewise, are adjustable, achieve the same result. This permits use of threads of different or surface characteristics to be fed by the respective rollers 35, 511 and not merely selection of threads based on color alone. The operating magnets provide for rapid disengagement of the controlled levers from a latched position, requiring only little power, while permitting a very short travel path of the respective pressure rollers.

A common reset arrangement insures that all pressure rollers are returned to the same quiescent position for a subsequent selection of a thread to be inserted in the shed. The mechanical construction of a common reset arrangement is simple and reliably prevents malfunction. A particularly simple arrangement is a common reset rod or bail 532. Alternatively, a cam shaft with cams 846 (FIG. 9) also provides a simple reset arrangement. The cam 846, FIG. 9, is shown schematically, and other cam constructions can be used.

A common housing for a plurality of pressure rollers, together with their bearings and reset arrangement, as illustrated by the unit 505, has the advantage that, again, the construction can be essentially modular, providing simple replacement, and excellent accessibility for maintenance, for example to repair or replace the surfaces of the respective pressure rollers 511. If desired, the entire housing can be positioned on a holder which slowly traverses from right to left, with respect to FIG. 5, so as to prevent formation of grooves or ridges in either the pressure rollers or the measuring roller 32, 32'.

Associating a single injector nozzle with each thread 518 (FIG. 5) has the advantage that the threads can be easily kept apart and possible twisting together or mutual interference is minimized. The injectors, preferably, are combined in the block 546, which can be constructed to match the construction of the respective storage region 542 of the shuttles 9. That injector which is located at the end first engaged by the trailing end of the shuttle may carry a thread brake for the trailing thread on the shuttle. The thread can be severed by a suitable, for example electrically operated cutter 99 (FIG. 4). A control unit 552 provides a simple and easily changeable arrangement to control the sequence of operations—release of thread brake, engagement of the respective pressure roller against the measuring drum, providing compressed air for injection, and cutting the thread, as well as resetting of the pressure rollers; and, when applied to the embodiment of FIGS. 5 to 9, additionally permits individual control with respect to specifically selected threads.

Synchronization of shuttle movement and the operation of the electromagnets 528, controlled by the control unit 552, can be obtained, easily, by coupling a position sensor 654 (FIG. 2) to the shaft driving the main shaft 22. The position sensor 654, of course, can be located differently, for example coupled directly to the shaft 22, or sensing the position of any one of the shuttles with respect to a reference, for example by contacting or noncontacting arrangements, including light gates, magnetic pick-ups and the like. Such position sensors are usually present anyway in apparatus of this kind, even if the synchronization control is carried out mechanically via the shafts 90, and gears and gear belts 91, 92, 93. The position sensor 654, thus, provides synchronization signals of the relative position of the drive shafts, and hence of the positions, via the input line 554 to the control unit 552, so that the control unit 552 will be coupled for synchronization with the rotation of the main loom drive shaft and for providing the output signals to the solenoid magnets 528 in proper timed sequence as the shuttles 9 move in front of the respective injectors, in accordance with the selected thread 518.

The control unit 552 (FIG. 6) also provides output signals to operate the thread brake 50, for example over a connecting line 651. The thread brake 50, then, can be electromagnetically operated pulling the brake shoe 48 (FIG. 3) against the fixed shoe 49 or, respectively, releasing it counter a spring force. The control unit 552, also, can provide timed signals to the electromagnetic coil 100 of the cutter 99, to effect cutting of the thread after it has been delivered by the respective injector 544 (FIG. 5) over a line 600.

Various changes and modifications may be made, and features described in connection with any one of the embodiments may be used with any of the others within the scope of the inventive concept.

What is claimed is:

1. In a weaving loom having shuttle drive means (21, 22, 23, 24) including a loom drive shaft (22)

effecting and controlling movement of a plurality of shuttles (9) at a speed determined by the speed of rotation of said loom drive shaft;

pneumatic weft thread injection means (85, 546) injecting a weft thread of predetermined length into each of said shuttles during movement thereof past an injection station, a weft thread supply apparatus comprising a driven measuring drum (32, 32');

at least one pressure roller (35, 511), said pressure roller being movably journalled for movement between an engagement position with the measuring drum, with a weft thread (51, 518) therebetween, and a rest position spaced from the measuring drum;

operating means (36, 43, 509–532, 846) coupled to the at least one pressure roller for controlling movement thereof between said engagement and said rest positions;

control means (43, 552) connected to and controlling the operating means, to control engagment of the at least one pressure roller with the measuring drum to supply, to said injection means, a weft thread of said predetermined length during the period of time that the shuttle to which said weft thread is to be supplied is in a thread-receiving position with respect to the injection means; and a thread brake (50) in the path of the thread to the measuring drum; and wherein the control means comprises a positive coupling means (34, 94, 654, 554) coupling the measuring drum (32, 32') as well as the operating means (36, 43, 509–532, 846) for the at least one pressure roller (35, 511) to the shuttle drive means (21–24) effecting and controlling movement of the shuttles, to provide for synchronism of injection of weft threads and movement of the shuttles past the injection position, wherein said positive coupling means comprises a main injector drive shaft (34, 54);

a positive drive connection (3234) between said main drive shaft and the measuring drum (32), the operating means (36, 43) being positively driven from said main drive shaft;

and a positive drive connection (90–96) between the loom drive shaft (22) and said main drive shaft; and wherein the control means (43, 552) is drivingly coupled to the main drive shaft (34).

2. The apparatus of claim 1, wherein said positive drive connection includes an intermediate gearing (94).

3. The apparatus of claim 1, further including a thread brake (50) and means (55; 552) for controlling operation of the thread brake in timed synchronism with movement of the associated pressure roller (35, 511) between the engagement position and the rest position, to brake a thread being supplied to the apparatus when the pressure roller is in rest position, and release the brake when the pressure roller is in engagement position.

4. The apparatus of claim 1, further including (FIGS. 3, 4) a thread retraction arrangement (56) located in the path of the thread in advance of the measuring drum (32) and operative to retract the thread from the weft thread injection means (85) by a predetermined distance after the at least one pressure roller, upon engagement with the measuring drum, has supplied a weft thread to the injector;

and retractor operation means (59, 60) positively coupled to said operating means for operation in time relation to the operation of the coupling means coupled to the pressure roller.

5. The apparatus of claim 1, further including a compressed air supply and controlled valve means (105, 550) controlling, respectively, admission of compressed air to said pneumatic weft thread injection means (85, 546) or throttling supply of said compressed air;

and compressed air control means (101, 102, 105; 552, 551) coupled to said controlled valve means and controlled by said operating means for controlling, selectively, admission of compressed air or throttling of compressed air in timed relation to movement of said at least one pressure roller (35, 511) between said engagement and said rest positions.

6. The apparatus of claim 1, further including a thread cutter (99) positioned for cutting a weft thread being injected into a shuttle in thread receiving position with respect to the pneumatic weft thread injection means (85);

and cutter control means (100, 101, 552) coupled to and controlled by said operating means for cutting a weft thread being supplied upon engagement of the at least one pressure roller (35, 511) with the measuring drum (32, 32') upon termination of feed of a weft thread to a shuttle (9) in weft thread receiving position with respect to the pneumatic weft thread injection means (85, 546).

7. The apparatus of claim 1, further including a measuring drum brake (72) coupled to a shaft (33) of said measuring drum for rapidly stopping the measuring drum upon stopping of said weaving loom to reduce stress on said positive coupling means coupling the measuring drum (32, 32') to the shuttle drive means (21–24).

8. The apparatus of claim 1, further including a plasma-applied high-friction, wear-resistant coating (34) placed on the circumference of said measuring drum (32).

9. The apparatus of claim 1, wherein a housing or frame structure (31, 505) is provided, and at least the measuring drum and the at least one pressure roller (35, 511) are secured in said housing or frame structure as a single modular unit for coupling with said positive coupling means;

and wherein said positive coupling means comprises a main injector shaft (34, 35) and gear drive means (3234) to said measuring drum (32, 32').

10. The apparatus of claim 1, further comprising a thread traverse apparatus (75) synchronized with rotation of said measuring drum (32) and axially traversing the thread across said measuring drum and driven by said positive coupling means.

11. The apparatus of claim 1, wherein said control means includes a first control cam element (43), which first control cam element is drivingly coupled to said main injector drive shaft (34, 54).

12. The apparatus of claim 11, wherein said positive drive connectiion includes an intermediate gearing (94);

wherein said first control cam element (43) is directly secured to said main injector drive shaft (34, 54), and the transmission ratio of the intermediate gearing is so selected that the main injector drive shaft rotates over one full revolution during the period of time that a shuttle passes along a predetermined shuttle path in front of said pneumatic weft thread injection means to cover the distance (98) of shuttle movement for injection of a complete weft thread into the shuttle.

13. The apparatus of claim 12, further including a thread brake (50) coupled to be driven and operated by said first control cam element in timed synchronism with operation of said pressure roller (35, 511) to brake a thread (51, 518) being supplied to said apparatus when the respective pressure roller (35, 511) is in the rest position, and to release the brake when the respective pressure roller is in engaged position with the measuring drum.

14. The apparatus of claim 11, further including a second control cam element (55), driven by said main injector drive shaft (34, 54), and a thread brake (50) coupled to be driven and operated by said second control cam element in timed synchronism with the operation of said first control cam elememt (43) to release the thread brake when the first control cam element controls the associated pressure roller (35, 511) for engagement with the measuring drum (32, 32') and to brake a thread (51, 518) being supplied to said apparatus when the associated pressure roller (35, 511) is in the rest position.

15. The apparatus of claim 11, further including (FIGS. 3, 4) a thread retraction arrangement (56) located in the path of the thread in advance of the measuring drum (32) and operative to retract the thread from the weft thread injection means (85) by a predetermined distance after the at least one pressure, upon engagement with the measuring drum, has supplied a weft thread to the injector;

and a third control cam (60) driven by said main injector drive shaft (34, 54) and controlling operation of the thread retraction arrangement (56) in timed relation to the operation of said first control cam and, hence, movement of the at least one pressure roller (35, 511) between said rest position and said engagement position.

16. The apparatus of claim 15, wherein said thread retraction arrangement comprises a movable thread guide arm (58) and a thread clamp (64) secured to a frame of said apparatus out of a straight path of the thread to a circumferential position on the measuring drum, said movable thread guide arm (58) being movable under control of said third control cam (60) to push a thread into the thread clamp, the thread being removable from the thread clamp upon engagement of the at least one pressure roller (35, 511) with the measuring drum (32, 32').

17. The apparatus of claim 16, wherein the thread clamp (64) comprises two dished elements (68) elastically biased towards each other and offset from the path of the thread (51) to a circumferential position on the driven measuring drum (32, 32'), said movable thread guide arm (58) including at least one thread guide element (63) which is movable towards said dished elements (68) to guide a thread for clamping therebetween.

18. The apparatus of claim 11, further including a compressed air supply and controlled valve means (105, 550) controlling, respectively, admission of compressed air to said pneumatic weft thread injection means (85) or throttling supply of said compressed air;

and compressed air control means (101, 102; 105, 552, 551) coupled to said controlled valve means and controlled by said operating means for controlling, selectively, admission of compressed air or throttling of compressed air in timed relation to movement of said at least one pressure roller (35, 511) between said engagement and said rest positions;

and wherein said compressed air control means comprises a fourth control cam element (101) positioned on said main drive shaft (34, 54) and coupling means (102) in engagement with said fourth control cam element and controlling said compressed air control means in accordance with the rotary position of said fourth control cam element to throttle compressed air supply when the first control cam controls the pressure roller (35) to be in rest position.

19. The apparatus of claim 11, further including a thread cutter (99) positioned for cutting a weft thread being injected into a shuttle in thread receiving position with respect to the pneumatic weft thread injection means (85);

and cutter control means (100, 101,102) coupled to and controlled by said operating means for cutting a weft thread being supplied upon engagement of the at least one pressure roller (35, 511) with the measuring drum (32, 32') upon termination of feed of a weft thread to a shuttle (9) in thread receiving position with respect to the pneumatic weft thread injection means (85, 546);

and wherein said cutter control means comprises a control cam element (101) in driving relation with said main injector drive shaft (34, 54) for timed operation of said weft thread cutter (99) with respect to movement of the shuttles (9) in the weaving loom.

20. The apparatus of claim 11, further including at least one additional control cam element (55, 60, 101) secured to the main injector drive shaft;

and wherein at least one of said control cam elements is adjustably located on said main drive shaft to permit, respectively, adjustment of the circumferential position or cam shape of the respective control cam elements on said main drive shaft and hence adjustment of positioning with respect to the shuttle drive means.

21. The apparatus of claim 11, further including at least one additional control cam element (55, 60, 101, 103) located on said main drive shaft;

and wherein cam followers including at least one of: mechaical cam follower elements; electrical scanning elements; pneumatic scanning elements are coupled in scanning relationship with respect to said control can elements to permit controlling of operating parameters in timed relationship to movement of said at least one pressure roller (35, 511) between said engagement and rest positions.

22. The apparatus of claim 1, wherein (FIGS. 5–9) a plurality of pressure rollers (511) are provided, one each associated with a respective weft thread;

the weft thread injection means includes a plurality of injection nozzles (545) receiving the respective weft threads and injecting said weft threads into a shuttle (9) at the injection station;

and wherein the operating means (509–532; 846) include bias force means (514) acting on the respective pressure rollers, and tending to press the pressure rollers against the measuring drum (32'), locking means (528, 522) retaining the pressure rollers in the rest position spaced from the measuring drum, and permitting, under control of the control means (552) unlocking of a selected pressure roller, and movement thereof to the engagement position under action of the bias force of the respective bias force means (514), and reset means (530,531,531*a*) coupled to the pressure rollers and returning a selected pressure roller to rest position after delivery of a weft thread by the selected pressure roller, said reset means being connected to and controlled by said shuttle drive means (21, 22, 23, 24) of the weaving loom to reset the selected pressure roller when the shuttle having the respective weft thread injected therein has traveled past the injection nozzle of the respective weft thread and received said predetermined length of weft thread.

23. The apparatus of claim 22, wherein the bias force of said bias force means of each of the respective pressure rollers (511) is individually adjustable.

24. The apparatus of claim 22, wherein the operating means includes a plurality of levers (509) pivotable about a common axis (508), the respective pressure rollers (511) being individually journalled on said levers, the bias force means (518) applying the respective bias force for the respective pressure roller (511) against the respective levers.

25. The apparatus of claim 24, wherein said locking means (522) comprise latch elements (521) individually engageable with each of said levers (509);

and latch bias force means (522, 523, 524) resiliently retaining said latch elements (521) in engagement with the respective levers.

26. The apparatus of claim 25, wherein the operating means comprise electromagnetic means operable to unlatch said levers upon energization to pull the latch elements counter the direction of said bias force means.

27. The apparatus of claim 24, wherein said reset means is common to all said pressure rollers and is effective to engage any one of said locking means to reset any selected pressure roller into rest position;

and wherein said reset means comprises a reset element (31, 31*a*) engageable with any one of said levers (509) on which said pressure rollers (511) are journalled.

28. The apparatus of claim 27, wherein (FIGS. 5–7) the reset element (31) comprises a reset bail or bar (32) extending essentially parallel to said pivot axis (508) and across said levers (509), said bail or bar having an offset portion (33) and being pivotable for engagement of the offset portion with any one of said levers (9).

29. The apparatus of claim 27, wherein (FIGS. 4, 5) the reset element comprises a cam shaft and a plurality of cams (846) located on said cam shaft and engageable with respective ones of said levers (509).

30. The apparatus of claim 22, wherein said reset means is common to all said pressure rollers and is effective to engage any one of said locking means to reset any selected pressure roller into rest position.

31. The apparatus of claim 22, further comprising a common frame or housing (505) retaining at least all said pressure rollers (511) and means (509) rotatably retaining said pressure rollers, in position in the apparatus.

32. The apparatus of claim 22, wherein said pneumatic injection means comprises a plurality of injector nozle elements (545, 544) combined together to form a unitary injector block (546).

33. The apparatus of claim 22, wherein said pneumatic injection means comprises an individual injection nozzle (544, 543) for each respective weft thread.

34. The apparatus of claim 33, further including a wedge-shaped projection (548) extending counter the direction of movement (547) of the shuttle (9) from at least one of the injectors (545) for cooperation with a shuttle thread brake.

35. The apparatus of claim 22, wherein the control means comprises a programmable control unit (552) controlling, individually, the operating means (528) for controlling movement of the respective pressure rollers (511) and receiving incoming data information relative to the position of the respective shuttle (9) to be supplied with a selected weft thread.

36. The apparatus of claim 35, including a compressed air supply (550') and individual control valves (550) connecting said compressed air supply to the respective injectors of the weft thread injection means (546);

and wherein said control unit (552) controls the respective valves (550) for, selectively, applying compressed air to the respective injector for injecting a weft thread into a shuttle passing beneath the injector and, thereafter, throttling air flow through the injector.

37. In a weaving loom having drive means (21, 22, 23, 24) effecting and controlling movement of a plurality of shuttles (43), pneumatic weft thread injection means (46) injecting a selected weft thread of predetermined length in a respective shuttle during movement of the shuttle past an injection station, said apparatus comprising a driven measuring drum (3);

a plurality of pressure rollers (511), one each associated with a respective weft thread (518), said pressure rollers being journalled for movement between an engagement position with the measuring drum, with the associated weft thread therebetween, and a rest position spaced from the measuring drum;

operating means (520, 529, 528) coupled to the respective pressure rollers for controlling movement of the respective pressure roller between said engagement and rest positions;

control means (552) connected to and controlling the operating means (520–529);

said injection means (546) including a plurality of weft thread injection nozzles (545) receiving the respective weft threads and injecting said threads into a shuttle ((9) at said injection station;

bias force means (514) acting on said pressure rollers (511) and tending to press the pressure rollers against the measuring drum (32');

locking means (528, 522) retaining the pressure rollers in the rest position spaced from the measuring drum, said locking means forming part of said operating means and permitting, under control of said control means (552), unlocking of a selected pressure roller and movement thereof to the engagement position under action of the bias force of said bias force means (514);

and reset means (530) coupled to the pressure rollers and returning said pressure rollers after delivery of a weft thread by the pressure roller into said rest position, said reset means being connected to and controlled by said drive means (21, 22, 23, 24) of the weaving loom to reset the pressure roller when the shuttle having the respective weft thread injected therein has traveled past the injection nozzles and received said predetermined length of weft thread.

38. The apparatus of claim 37, wherein the operating means include a plurality of levers (509) pivotable about a common axis (508), the respective pressure rollers (511) being individually journalled on said levers, the bias force means (518) applying the respective bias force for the respective pressure roller (511) against the respective levers.

39. The apparatus of claim 38, wherein the control means comprises a programmable control unit (552) controlling, individually, the operating means (528) for controlling movement of the respective pressure rollers (511) and receiving incoming data information relative to the position of the respective shuttle (9) to be supplied with a selected weft thread.

40. The apparatus of claim 37, wherein said reset means is common to all said pressure rollers and is effective to engage any one of said pressure rollers to reset any selected pressure roller into rest position;

and wherein said reset means comprises a reset element (**31, 31*a*) engageable with any one of said levers (509) on which said pressure rollers (511**) are journalled.

41. The apparatus of claim 37, wherein the control means comprises a programmable control unit (552) controlling, individually, the operating means (528) for controlling movement of the respective pressure rollers (511) and receiving incoming data information relative to the position of the respective shuttle (9) to be supplied with a selected weft thread.

* * * * *